US009914576B2

(12) United States Patent
Konicke

(10) Patent No.: US 9,914,576 B2
(45) Date of Patent: Mar. 13, 2018

(54) PACKAGE WITH TAMPER-EVIDENT FEATURE

(71) Applicant: Berry Plastics Corporation, Evansville, IN (US)

(72) Inventor: James F Konicke, Muskego, WI (US)

(73) Assignee: Berry Plastics Corporation, Evansville, IN (US)

( * ) Notice: Subject to any disclaimer, the term of this patent is extended or adjusted under 35 U.S.C. 154(b) by 83 days.

(21) Appl. No.: 14/854,478

(22) Filed: Sep. 15, 2015

(65) Prior Publication Data

US 2017/0073136 A1 Mar. 16, 2017

Related U.S. Application Data

(60) Provisional application No. 62/052,126, filed on Sep. 18, 2014.

(51) Int. Cl.
*B65D 85/00* (2006.01)
*B65D 77/20* (2006.01)

(52) U.S. Cl.
CPC ..... *B65D 77/2096* (2013.01); *B65D 77/204* (2013.01); *B65D 2101/0023* (2013.01); *B65D 2577/2091* (2013.01)

(58) Field of Classification Search
CPC ..... B65D 77/36; B65D 77/20; B65D 77/28; B65D 55/06; B65D 55/0818; B65D 2101/00; B65D 2101/0007; B65D 5101/0053; B65D 5/542; B65D 5/706; B65D 5/705; B65D 5/54; B65D 77/2096; B65D 77/204; B65D 2101/0023; B65D 2577/2091
USPC ..... 206/459.5, 807; 229/117.31, 200, 227, 229/237, 202, 123.2; 333/459.5, 807
See application file for complete search history.

(56) References Cited

U.S. PATENT DOCUMENTS

| | | | | |
|---|---|---|---|---|
| 2,967,010 | A * | 1/1961 | Cuffey, Jr. | B65D 5/54 206/449 |
| 3,410,476 | A | 11/1968 | Buttery | |
| 4,572,377 | A | 2/1986 | Beckett | |
| 4,609,107 | A * | 9/1986 | Martin | B29C 66/4312 383/210 |
| 4,881,656 | A | 11/1989 | Chumley | |
| 6,318,894 | B1 | 11/2001 | Derenthal | |
| 6,644,491 | B2 | 11/2003 | Dewig et al. | |
| 7,681,732 | B2 * | 3/2010 | Moehlenbrock | B32B 7/12 206/459.1 |
| 9,511,894 | B2 * | 12/2016 | Wilson | B31B 1/14 |
| 2004/0118852 | A1 | 6/2004 | Barmore et al. | |
| 2004/0206637 | A1 | 10/2004 | Sierra-Gomez et al. | |
| 2008/0037911 | A1 | 2/2008 | Cole et al. | |
| 2008/0156861 | A1 | 7/2008 | Sierra-Gomez et al. | |
| 2008/0240627 | A1 | 10/2008 | Cole et al. | |

(Continued)

OTHER PUBLICATIONS

PCT International Search Report and Written Opinion completed by the ISA/US and issued in connection with PCT/US2015/050360.

*Primary Examiner* — J. Gregory Pickett
*Assistant Examiner* — Rafael Ortiz
(74) *Attorney, Agent, or Firm* — Barnes & Thornburg LLP

(57) ABSTRACT

A container closure in accordance with the present disclosure is coupled to a tamper-evident tear strip. The container closure is adapted to be mated with a container to cover an interior region formed in the container and to provide a package.

19 Claims, 6 Drawing Sheets

(56) References Cited

U.S. PATENT DOCUMENTS

| | | | | |
|---|---|---|---|---|
| 2008/0265008 | A1* | 10/2008 | Holley | B65D 5/2033<br>229/117.14 |
| 2013/0056470 | A1* | 3/2013 | Hallak | B65D 75/5855<br>220/270 |
| 2014/0048438 | A1* | 2/2014 | Woo | B65D 53/08<br>206/459.1 |

* cited by examiner

PACKAGE WITH TAMPER-EVIDENT FEATURE

PRIORITY CLAIM

This application claims priority under 35 U.S.C. § 119(e) to U.S. Provisional Application Ser. No. 62/052,126, filed Sep. 18, 2014, which is expressly incorporated by reference herein.

BACKGROUND

The present disclosure relates to a package and, in particular, to a package including a container and a closure for a top aperture opening into an interior region formed in the container. More particularly, the present disclosure relates to a tamper-evident feature for a container closure.

SUMMARY

A package includes a container and a closure for the container. The container is formed to include an interior product-storage region and a top aperture opening into the interior product-storage region. The closure is arranged to close the top aperture.

In illustrative embodiments, the closure is joined to a tamper-evident tear strip having a container-anchor portion and a finger-pull tab by a frangible connector extending along an undulated boundary line provided by the closure and the container-anchor portion of the tear strip to form a container label. The container label is applied to the container at a container-filling factory after product has been placed in the interior product-storage region formed in the container. A perimeter portion of the container closure and at least the container-anchor portion of the tear strip are bonded temporarily to a top wall of the container at the factory to mount the label to the top wall of the container in a position closing the top aperture that is formed in the top wall. The frangible connector joins one edge of the container closure to an adjacent edge of the container-anchor portion of the tear strip.

In illustrative embodiments, the frangible connector provided in the container label comprises a series of tear fields that are arranged to lie in spaced-apart relation to one another along the undulated boundary line. A somewhat C-shaped boundary aperture is arranged to extend along the undulated boundary line established between the container closure and the tear strip and formed in the container label to extend between each pair of adjacent tear fields. Several C-shaped boundary apertures are formed to lie in end-to-end relation in the container label.

Consumers are able to determine if the package they are purchasing has been tampered with by viewing the label on the container. If the tamper-evident tear strip included in the label is missing when the consumer purchases the package, then the consumer is put on notice that someone else may have tampered with the package. After the tear strip is removed by the consumer the first time the package is opened, the remaining closure included in the label can be peeled back to open the top aperture formed in the top wall of the container. Although an endless perimeter portion of the closure is bonded hermetically to a portion of the top wall of the container extending around the top aperture at the container-filing factory, the closure also includes an unbonded grip portion that is arranged to extend along the frangible connector and to be gripped easily by a consumer to initiate peel back of the closure after the tear strip has been removed to expose a free end of the grip portion. Illustratively, the closure is resealable so that it can be mated to the top wall of the container by the consumer after the package has been opened to cover the top aperture and reclose the package.

During removal of the tear strip, each of the tear fields included in the frangible connector provided in the label is torn as the consumer pulls the tear strip away from the underlying container and the adjacent closure. In illustrative embodiments, the tear fields and the generally C-shaped boundary apertures located between the tear fields and along the undulated boundary line provided between the closure and the tear strip cooperate in accordance with the present disclosure to provide means for fracturing each tear field included in the frangible connector to cause separation of the tear strip from the closure along the undulated boundary line without unwanted tearing of the tear strip or the grip portion of the container closure during pulling movement of the finger-pull tab included in the tear strip in a direction (1) generally along the boundary line; (2) generally toward the closure at an acute angle to the boundary line; or (3) generally away from the closure at an acute angle to the boundary line.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
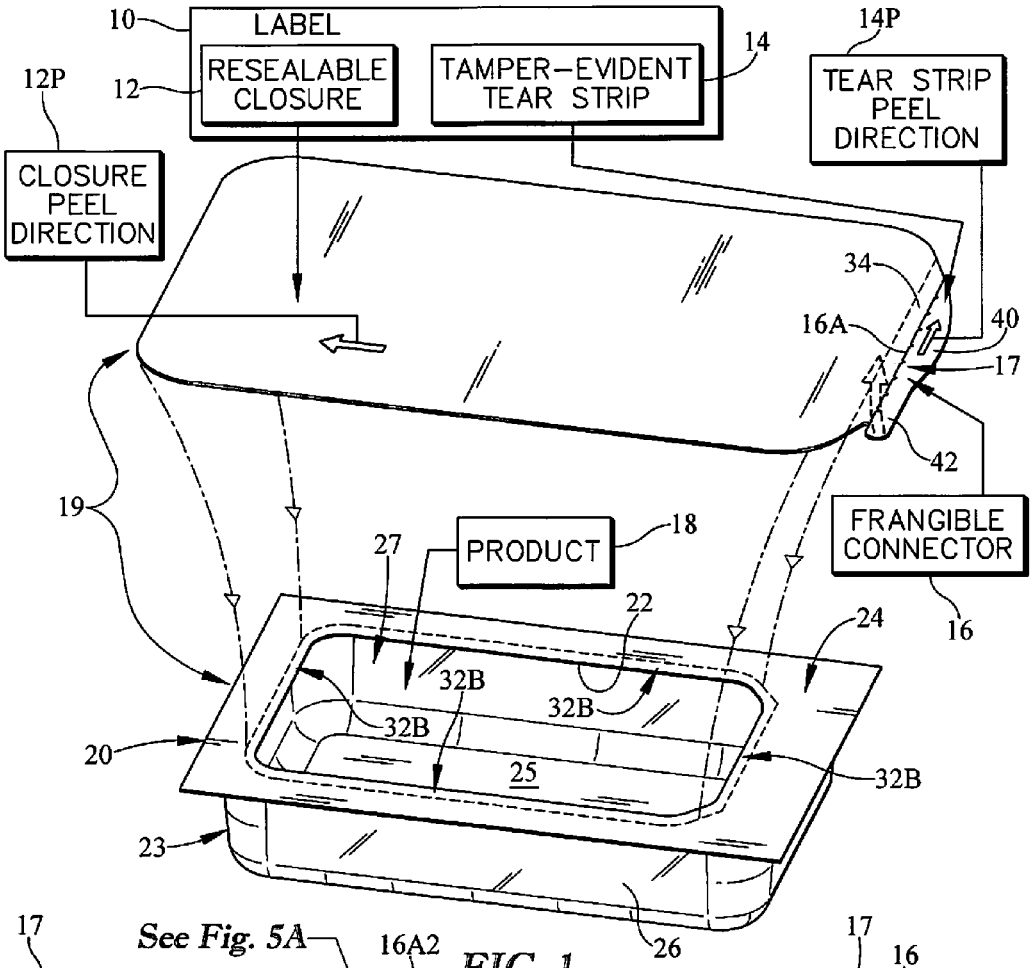
FIG. 1 is an exploded perspective assembly view of a package in accordance with the present disclosure showing that the package includes a container label comprising a releasable container closure, a tamper-evident tear strip, and a frangible connector provided between the container closure and the tear strip and an underlying container formed to include an interior product-storage region and showing that the label is sized and shaped to be bonded at a container-filling factory to a ring-shaped label-bonding zone provided on a top wall of the container and arranged to surround a top aperture formed in the top wall to open into the interior product-storage region of the container so as to cover and close the top aperture after product is placed in the interior product-storage region at the container-filling factory.
Figure 2:
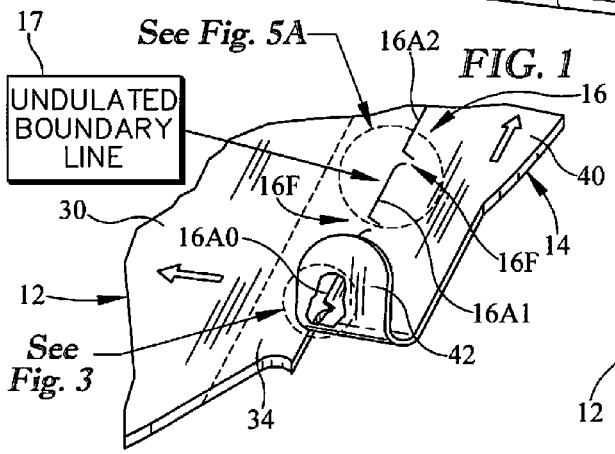
FIG. 2 is an enlarged perspective view of a portion of the container label of FIG. 1 showing upward movement of a finger-pull tab included in the tear strip to initiate controlled fracturing of the frangible connector provided between the container closure and the tear strip the first time the package is opened by a consumer that has purchased the package, with a portion of the finger-pull tab broken away to show a near end of an undulated boundary line provided between the container closure and the tear strip.
Figure 3:
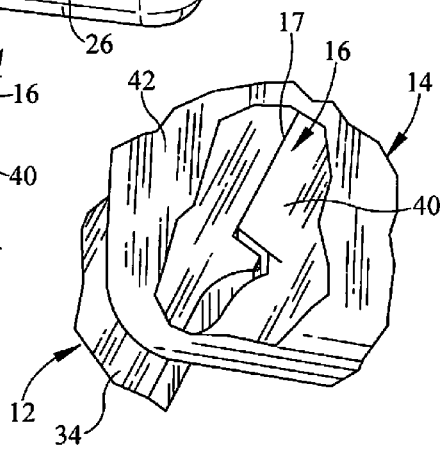
FIG. 3 is an enlarged view taken from one of the circled regions of FIG. 2.
Figure 4A:
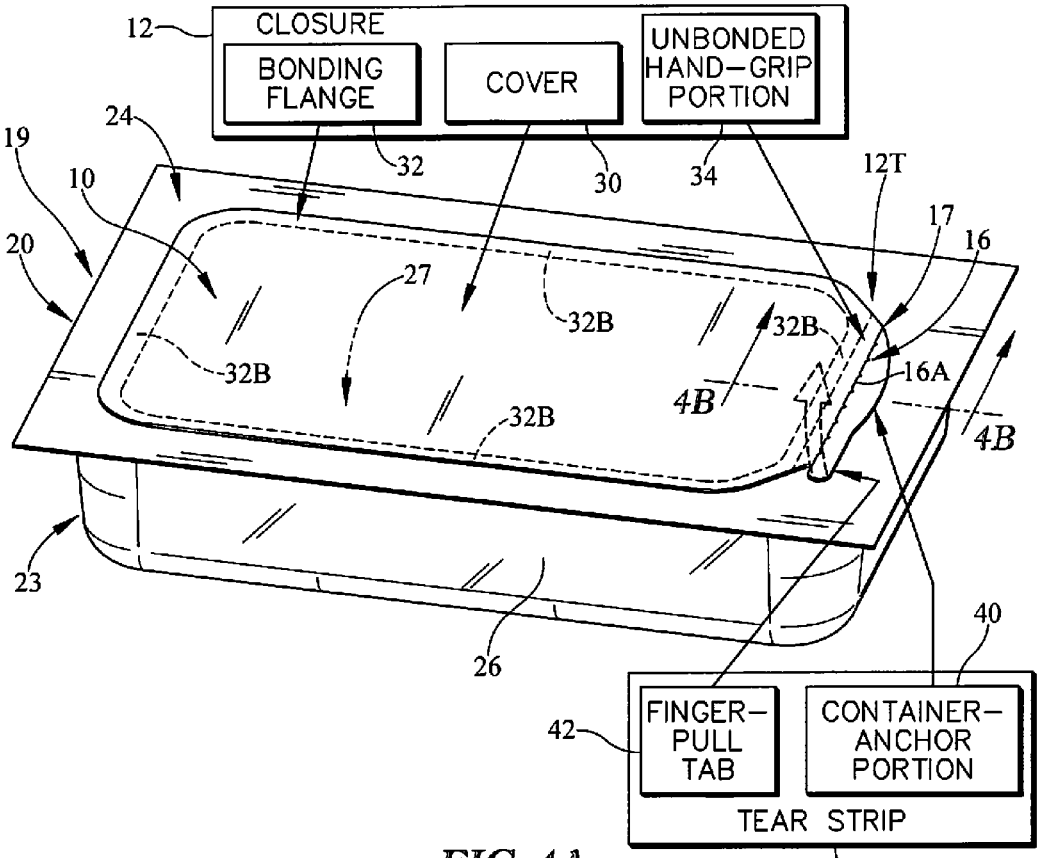
FIG. 4A is a perspective view of the package of FIG. 1 after the container label has been bonded to the top wall of the container to close the top aperture formed in the top wall and showing that the closure of the label includes a cover, a bonding flange arranged to surround the cover and to mate with the ring-shaped label-bonding zone provided on the top wall to support the cover in an aperture-closing position above the top aperture, and an unbonded grip portion that is not bonded to the underlying top wall of the container so that it can be gripped easily by a consumer after removal of the tear strip and used to peel back the closure as suggested in FIG. 7.
Figure 5A:
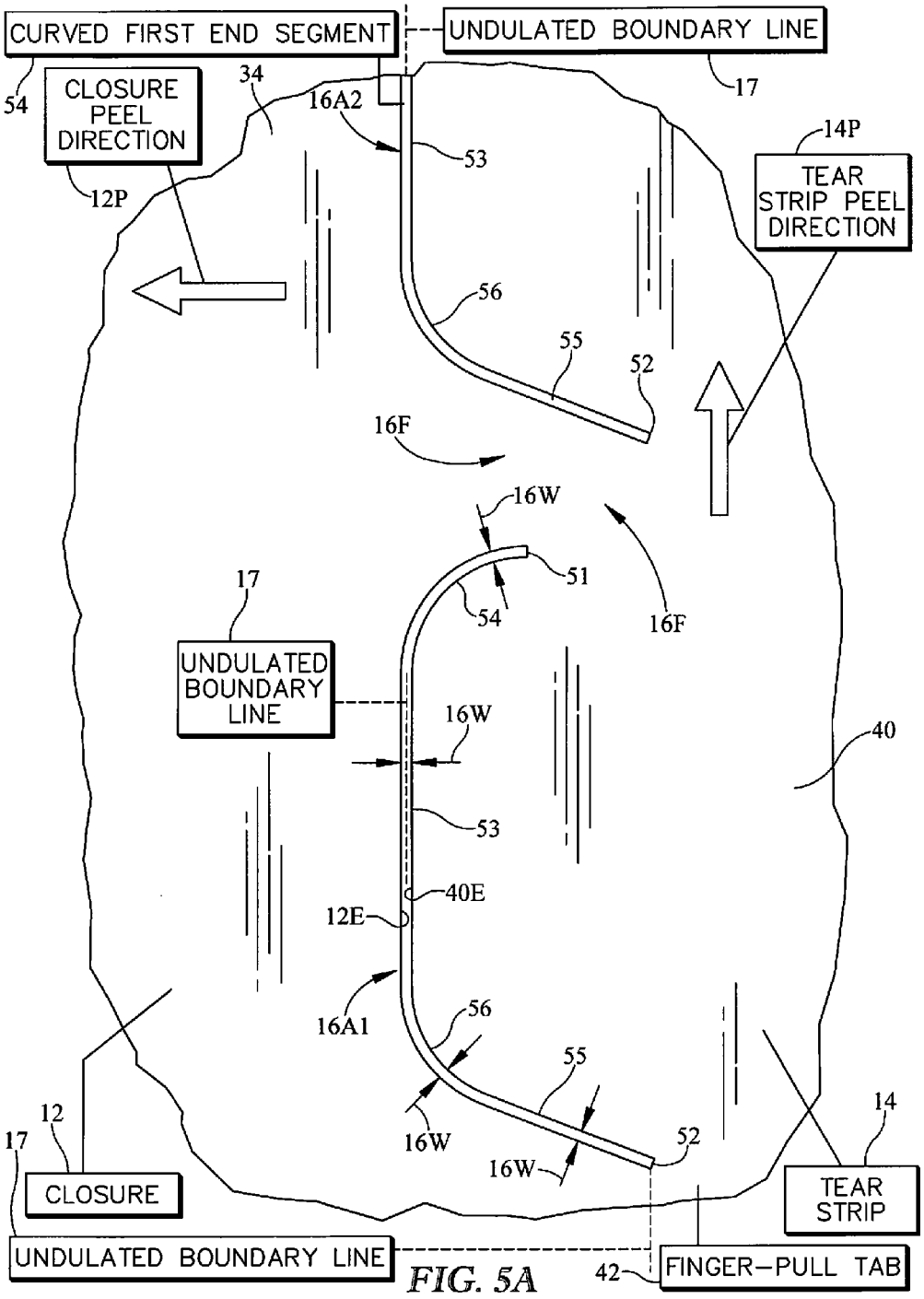
FIG. 5A is an enlarged portion of the container label taken from one of the circled regions of FIG. 2 showing a portion of the undulated boundary line provided between the container closure and the tear strip and showing one of the tear fields included in the frangible connector of the label and provided between one of the generally C-shaped boundary apertures that extend along the undulated boundary line and a portion of an adjacent C-shaped boundary aperture that also extends along the undulated boundary line.

A container label 10 in accordance with the present disclosure includes a closure 12, a tamper-evident tear strip 14, and a frangible connector 16 interconnecting closure 12 and tear strip 14 and extending along an undulated boundary line 17 as suggested in FIGS. 1, 2, and 5A. Container label 10 is coupled to an underlying container 20 at a container-filling factory as suggested in FIG. 1 to close a top aperture 22 formed in container 20 after a product 18 has been deposited in container 20 to produce a package 19 as shown, for example, in FIG. 4A. Container label 10 is a monolithic element made of a plastics material in illustrative embodiments of the present disclosure as suggested in FIG. 1.

Figure 6:
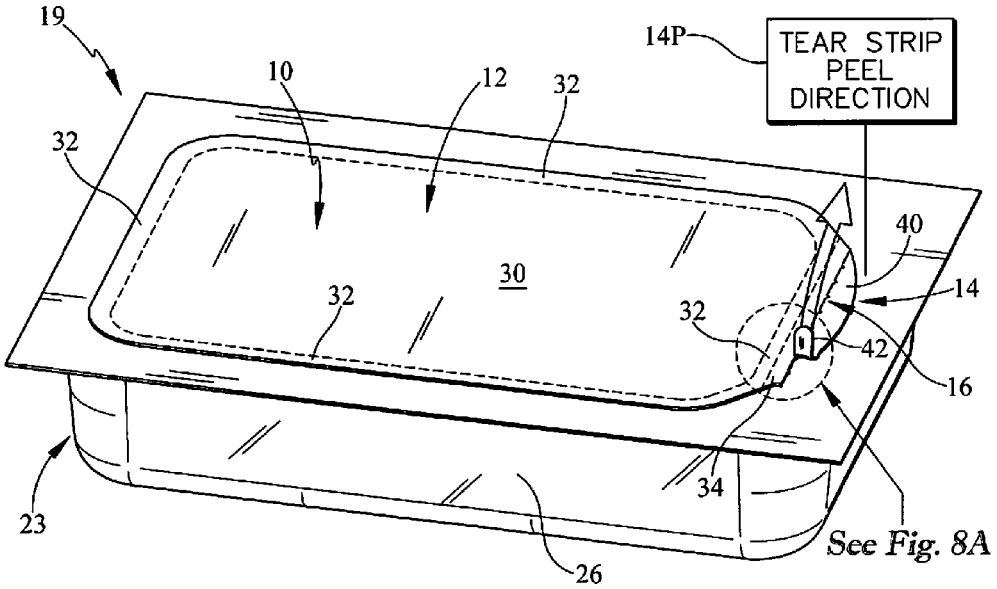
FIG. 6 is a perspective view of the package shown in FIG. 4A suggesting that a consumer can pull up on the finger-pull tab provided in the near end of the tear strip to initiate removal of the tear strip from the underlying top wall of the container and the adjacent container closure of the container label.
Figure 7:
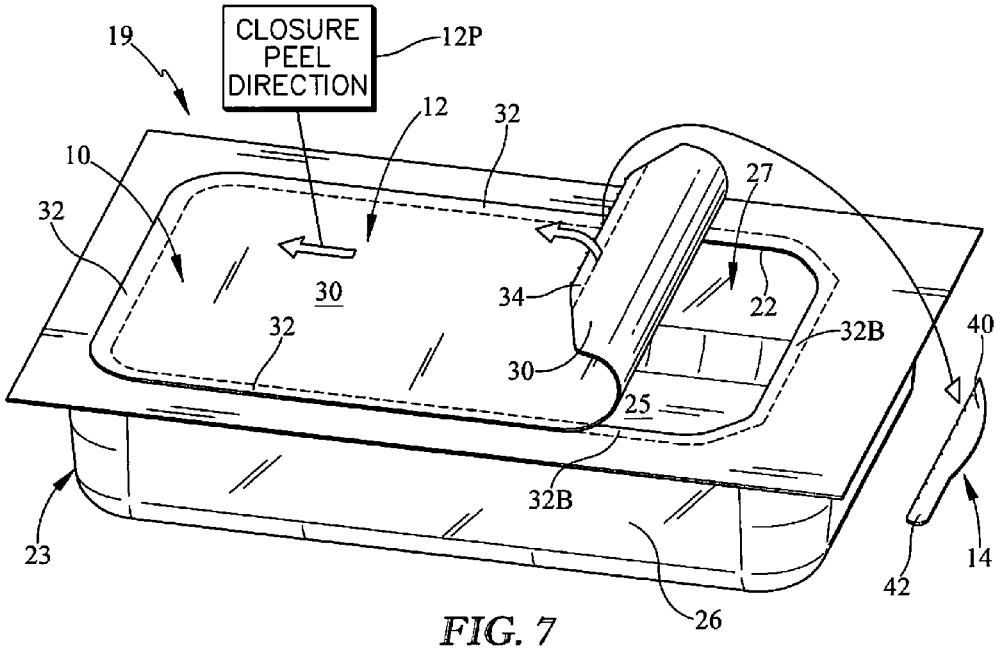
FIG. 7 is a view similar to FIG. 6 showing that each of the tear fields in the frangible connector has been torn and the tear strip has been separated from the closure and showing that the releasable container closure also included in the container label has been peeled in the closure peel direction to cause a portion of the container closure to separate from the top wall of the container to expose part of the top aperture formed in the top wall.

Closure 12 can be peeled back in closure peel direction 12P to open package 19 to access the stored product 18 as suggested in FIG. 7 after tamper-evident tear strip 14 has been peeled away in tear strip peel direction 14P as suggested in FIG. 6 to tear each of a series of spaced-apart tear fields 16F included in frangible connector 16 as suggested in FIG. 7. Boundary apertures 16A are provided between adjacent tear fields 16F and shaped to influence the tear pattern of tear fields 16F to minimize unwanted tearing of closure 12 and tear strip 14 as the tear fields 16F are torn by a consumer during removal of tear strip 14 regardless of the direction the tear strip 14 is pulled by a consumer relative to the undulated boundary line 17 the first time that package 19 is opened as suggested in FIGS. 8-10.

Container 20 includes a top wall 24 formed to include top aperture 22 that opens into an interior product-storage region 27 in an illustrative embodiment shown in FIG. 1. Container 20 also includes a bowl 23 underlying top wall 24 and having a floor 25 and a side wall 26 coupled to a perimeter edge of floor 25. Top wall 24 is coupled to a top edge of side wall 26 to define interior product-storage region 27. Product 18 is deposited into interior product-storage region 27 through top aperture 22 at a container-filling factory before container label 10 is coupled (e.g., bonded) to an exterior surface of top wall 24 as suggested in FIG. 1 to produce a closed and hermetically sealed package 19 shown, for example, in FIG. 4A.

Frangible connector 16 of container label 10 is arranged to interconnect the closure 12 and tamper-evident tear strip 14 also included in container label 10 as suggested in FIG. 1-5. Frangible connector 16 is configured to break in one of several expected manners owing, for example, to provision of tear fields 16F between adjacent pairs of boundary apertures 16A provided in frangible connector 16 along undulated boundary line 17 without causing unwanted tearing of closure 12 and tear strip 14 during removal of tear strip 14 from top wall 24 of container 20 and separation of tear strip 14 from closure 12 as suggested in FIGS. 8-10.

Frangible connector 16 of container label 10 is formed to include a series of spaced-apart generally C-shaped boundary apertures 16A arranged to extend along the undulated boundary line 17. Boundary apertures 16A0, 16A1, and 16A2 are shown, for example, in FIGS. 2, 3, and 5A. Boundary apertures 16A4 and 16A5 are shown, for example, in FIGS. 8B, 9B, and 10B. Frangible connector 16 is also formed to include a tear field 16F located between each pair of adjacent boundary apertures 16A as suggested in FIGS. 2 and 5A. Each tear field 16F in frangible connector 16 is torn by a consumer during removal of tear strip 14 from top wall 24 of container 20 and separation of tear strip 14 from closure as suggested in FIGS. 6 and 7 as tear strip 14 is peeled in tear strip peel direction 14P away from top wall 24 of container 20.

Closure 12 of container label 10 includes a cover 30, a bonding flange 32 arranged to surround cover 30, and an unbonded handgrip portion 34 appended to bonding flange 32 at a tear-strip end 12T of closure 12 as shown, for example, in FIG. 4A. Bonding flange 32 is arranged to mate with a ring-shaped label-bonding zone 32B provided on top wall 24 of container 20 to support cover 30 in an aperture-closing position above top aperture 22 as suggested in FIGS. 1 and 4A. As suggested in FIG. 4B, adhesive 32A is used to bond bonding flange 32 to top wall 24 of container 20 although any suitable bonding means may be used.

Figure 4B:
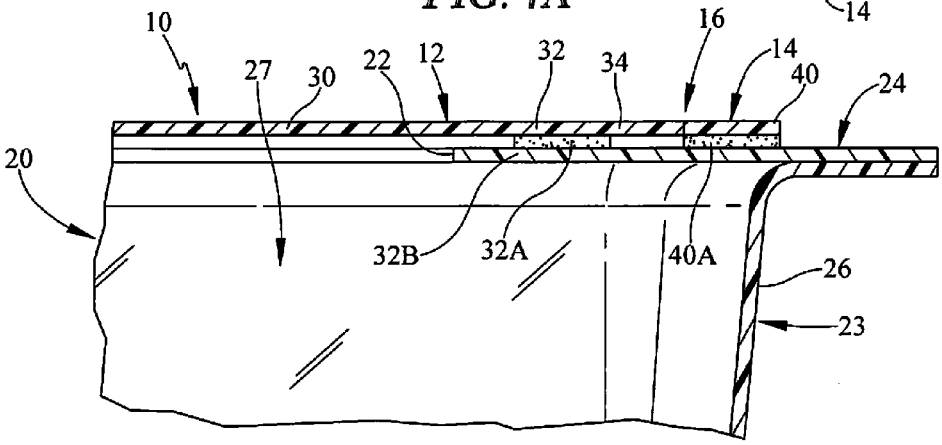
FIG. 4B is an enlarged sectional view of a portion of the package taken along line 4B-4B of FIG. 4A.

Unbonded handgrip portion 34 is arranged to interconnect bonding flange 32 and frangible connector 16 and is unbonded to top wall 24 of container 20 as suggested in FIGS. 4A and 4B. Once tear strip 14 is peeled away in tear strip peel direction 14P and removed as suggested in FIGS. 5 and 7, then unbonded handgrip portion 34 is exposed and can be gripped by a consumer that wishes to peel back closure 12 in closure peel direction 12P as suggested in FIG. 7 to open package 19 for the first time. In illustrative embodiments, once opened closure 12 is resealable to close top aperture 22; however, no hermetic seal between closure 12 and top wall 24 is re-established when closure 12 is mated with top wall 24 of container 20 by a consumer to reclose package 19.

Tamper-evident tear strip 14 includes a container-anchor portion 40 and a finger-pull tab 42 coupled to one end of container-anchor portion 40 as shown, for example, in FIG. 4A. Frangible connector 16 is arranged to interconnect unbonded handgrip portion 34 of closure 12 and container-anchor portion 40 of tear strip 14 prior to removal of tear strip 14 by a consumer the first time a package is opened. As suggested in FIG. 4B, adhesive 40A is used to bond container-anchor portion 40 of tear strip 14 to top wall 24 of container 20 although any suitable bonding means could be used. Finger-pull tab 42 is unbonded to the underlying top wall 24 of container 20 so that it can be gripped easily and pulled upwardly by a consumer as suggested in FIGS. 2 and 6 to initiate removal of tear strip 14.

Each boundary aperture 16A included in frangible connector 16 has a generally C-shaped profile in illustrative embodiments as suggested in FIG. 2. For example, boundary aperture 16A1 is C-shaped as shown in FIG. 2 and has a first terminal end 51 at a first end and a second terminal end 52 at an opposite second end as shown in FIG. 5A. First terminal end 51 serves as a tear initiation point for tear field 16F during removal of tear strip 14 as suggested in FIG. 5B. In some instances, second terminal end 52 will serve as a tear completion point 523 as suggested in FIGS. 5B, 10A, and 10B. Tear field 16F is positioned to lie between first termination end 51 of a first generally C-shaped boundary aperture 16A1 and a second terminal end 52 of an adjacent second generally C-shaped boundary aperture 16A2 as shown, for example, in FIGS. 5A and 5B.

In illustrative embodiments, as shown in FIG. 5A, boundary aperture 16A1 comprises a straight middle segment 53 arranged to lie between first terminal end (tear initiation point) 51 and second terminal end 52, a curved first end segment 54 arranged to interconnect straight middle segment 53 first terminal end 51, a negatively sloping straight second end segment 55 arranged to terminate at second terminal end 52, and a curved middle segment 56 arranged to interconnect straight middle segment 53 and the negatively sloping straight second end segment 55. In an illustrative embodiment, an included angle of about 68.7° is defined between the negatively sloping straight second end segment 55 and a straight reference line 53R providing an extension of straight middle segment 53 as shown in FIG. 5B.

Figure 5B:
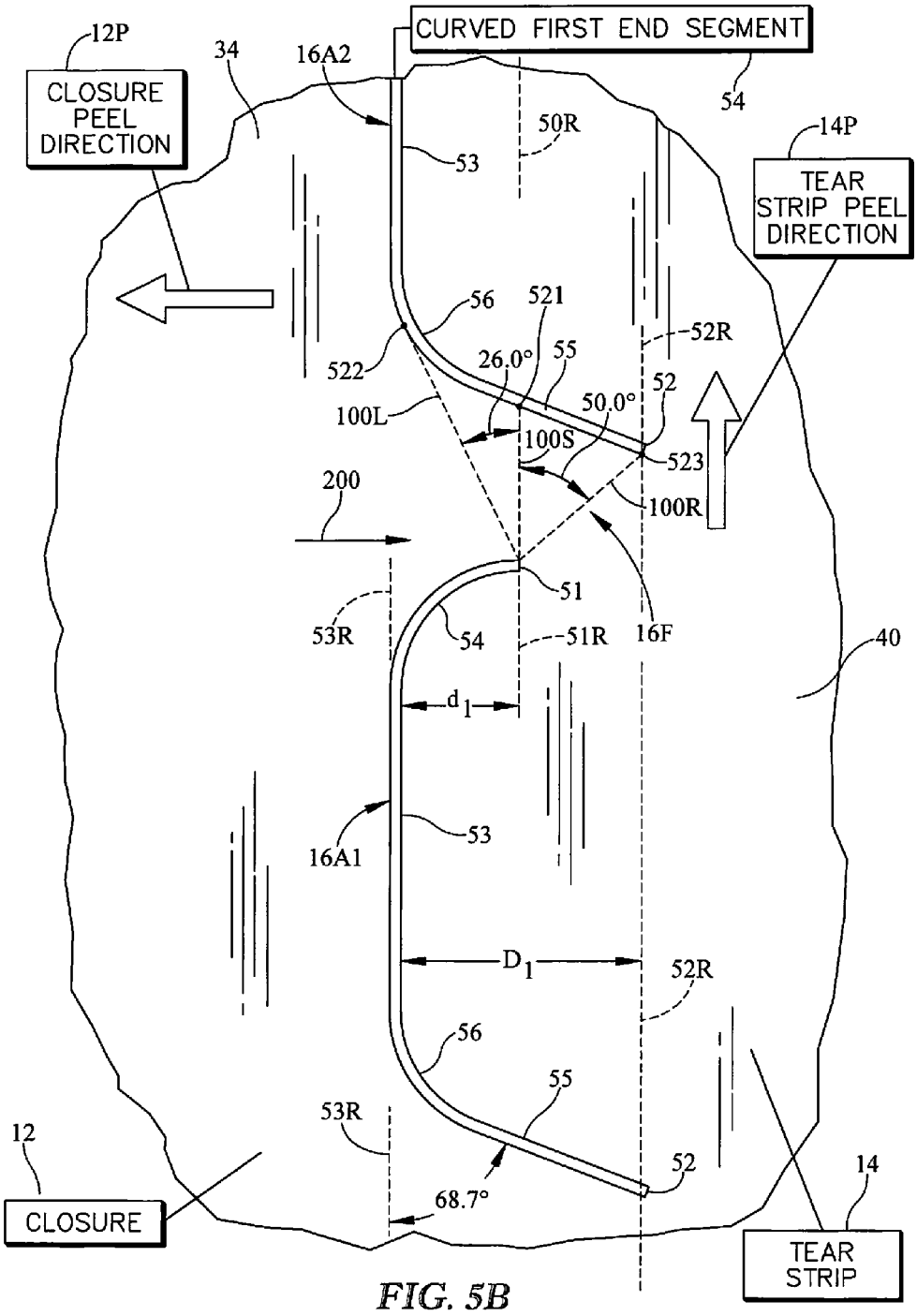
FIG. 5B is a view similar to FIG. 5A showing three illustrative and alternative tear patterns in one of the tear fields of the frangible connector, which illustrative and alternative tear patterns are shown separately in FIGS. 8, 9, and 10.

As suggested in FIG. 5B, curved first end segment 54 of boundary aperture 16A1 terminates at first terminal end (tear initiation point) 51 and extends toward first terminal end 51 in a direction 200 that is opposite (e.g., 180°) to closure peel direction 12P. Any tear in tear field 12F that originates at first terminal end (tear initiation point) 51 will intersect the downstream boundary aperture 16A2 as suggested in FIG. 5B. Tear lines 100L, 100R and the illustrated angles 26.0° and 50.0° are illustrative and are not limiting. The negatively sloping straight second end segment 55 starts at second terminal end 52 and extends away from second terminal end 52 generally in the closure peel direction 12P as suggested in FIG. 5B.

Three illustrative and alternative tear patterns of tears that could be made in a tear field 16F provided between two boundary apertures 16A1, 16A2 during removal of tear strip 14 are shown in FIG. 5B. In each case, the tear in tear field 16F begins during peeling movement of tear strip 14 in tear strip peel direction 14P at the first terminal end (tear initiation point) 51 of a first boundary aperture 16A1 and ends at a tear completion point (e.g., one of points 521, 522, or 523) along the negatively sloping straight second end segment 55 or the curved middle segment 56 of the second boundary aperture 16A2 as suggested in FIG. 5B.

Figure 8A:
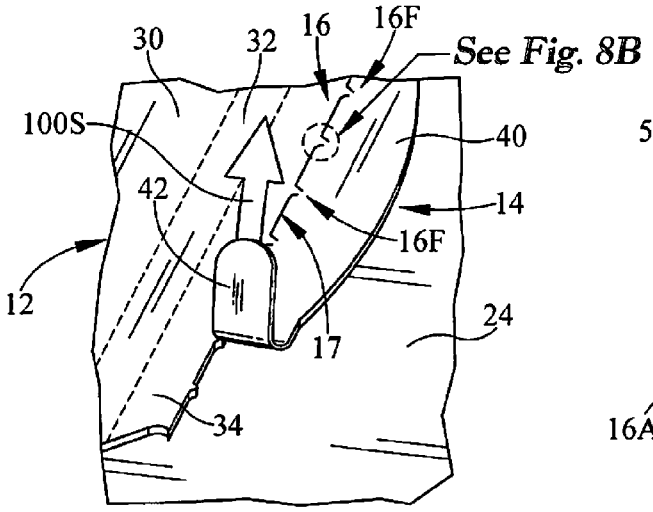
FIG. 8A is a perspective view of the circled region of FIG. 6 showing that the finger-pull tab included in the near end of the tear strip is being pulled straight up and along the boundary line provided between the container closure and the tear strip by a consumer to tear each of the tear fields in the frangible connector during removal of the tear strip from the underlying container and the adjacent container closure.
Figure 8B:
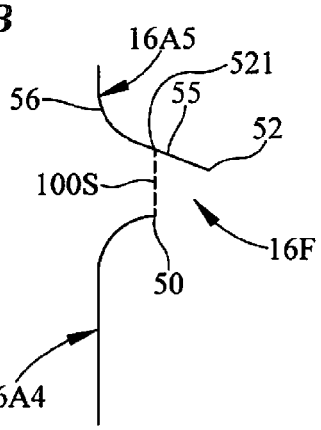
FIG. 8B is an enlarged diagrammatic view of a portion of the frangible connector taken from a circled region of FIG. 8A showing an illustrative STRAIGHT tear line in the tear field that is created when the finger-pull tab is pulled up and along the undulated boundary line.
Figure 9A:
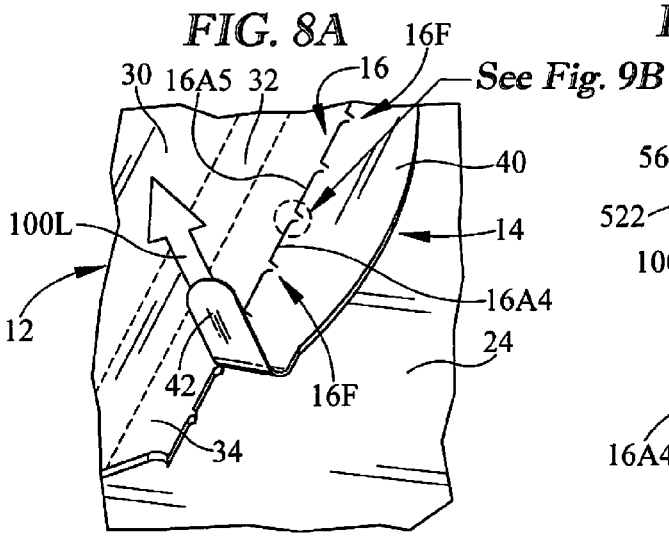
FIG. 9A is a perspective view similar to FIG. 8A showing that the finger-pull tab included in the near end of the tear strip is being pulled up and (to the left) toward the container closure at an angle to the undulated boundary line by a consumer to tear each of the tear fields in the frangible connector during removal of the tear strip from the underlying container and the adjacent container closure.
Figure 9B:
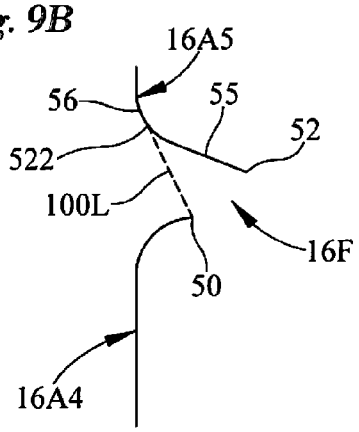
FIG. 9B is an enlarged diagrammatic view of a portion of the frangible connector taken from a circled region of FIG. 9A showing an illustrative ANGLED-LEFT tear line in the tear field that is created when the finger-pull tab is pulled up and (to the left) toward the container closure at an angle to the undulated boundary line.
Figure 10A:
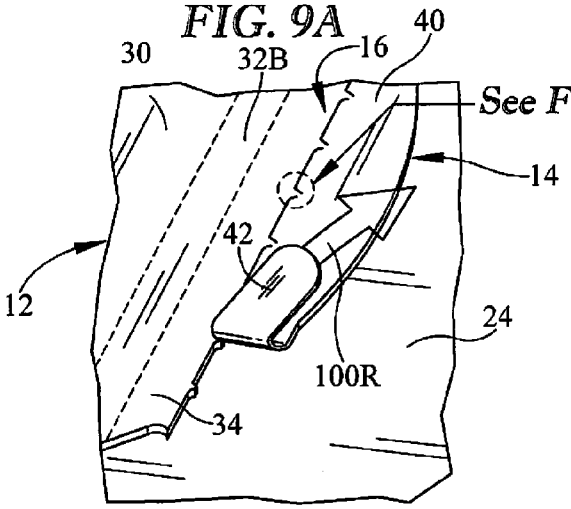
FIG. 10A is a perspective view similar to FIG. 8A showing that the finger-pull tab included in the near end of the tear strip is being pulled up and (to the right) toward the container closure at an angle to the undulated boundary line by a consumer to tear the tear fields in the frangible connector during removal of the tear strip from the underlying container and the adjacent container closure.
Figure 10B:
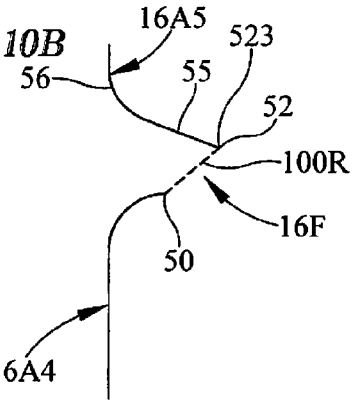
FIG. 10B is an enlarged diagrammatic view of a portion of the frangible connector taken from a circled region of FIG. 10A showing an illustrative ANGLED-RIGHT tear line in the tear field that is created when the finger-pull tab is pulled up and (to the right) away from the container closure at an angle to the undulated boundary line.

Alternative first, second, and third tear patterns 100S, 100L, and 100R are shown in FIG. 5B and also in FIGS. 8B, 9B, and 10B. In first tear pattern 100S, tear completion point 521 is provided on negatively sloping straight segment 55 as suggested in FIGS. 5B, 8A, and 8B. In second tear pattern 100L, tear completion point 522 is provided on curved middle segment 56. In third tear pattern 100R, tear completion point 523 is provided on negatively sloping straight segment 55 at second terminal end 52.

A consumer can pull up on finger-pull tab 42 provided in the near end of tamper-evident tear strip 14 to initiate removal of tear strip 14 from the underlying top wall 24 of container 20 and the adjacent container closure 12 of container label 10 as shown, for example, in FIG. 6. Each of the tear fields 16F provided in the frangible connector 16 has been torn and tear strip 14 has been separated from the closure 12 as suggested in FIG. 7. Container closure 12 has been peeled in closure peel direction 12P away from the ring-shaped label-bonding zone 32B provided on top wall 24 of container 20 to cause a portion of container closure 12 to separate from top wall 24 of container 20 to expose part of the top aperture 22 formed in top wall 24.

Consumers can pull handgrip portion 34 in several directions relative to undulated boundary line 17 while still generally peeling tear strip 14 in tear-strip peel direction 14P as suggested, for example, in FIGS. 8A, 9A, and 10A. For example, in a first case resulting in first tear pattern 100S, the finger-pull tab 42 included in the near end of tear strip 14 is being pulled straight up and along the undulated boundary line 17 provided between container closure 12 and tear strip 14 by a consumer to tear each of tear fields 16F provided in frangible connector 16 during removal of tear strip 14 from underlying container 20 and adjacent container close 12 as suggested in FIG. 8A. FIG. 8B is an enlarged diagrammatic view of a portion of the frangible connector 16 taken from a circled region of FIG. 8A showing an illustrative STRAIGHT tear line 100S in tear field 16F that is created when finger-pull tab 42 is pulled up and along the undulated boundary line 17.

In, for example, a second case resulting in second tear pattern 100L, finger-pull tab 42 included in the near end of tamper-evident tear strip 14 is being pulled up and (to the left) toward the container closure 12 at an angle to undulated boundary line 17 by a consumer to tear each of tear fields 16F in the frangible connector 16 during removal of tear strip 14 from underlying container 20 and adjacent container closure 12 is shown in FIG. 9A. FIG. 9B is an enlarged diagrammatic view of a portion of frangible connector 16 taken from a circled region of FIG. 9A showing an illustrative ANGLED-LEFT tear line 100L in tear field 16F that is created when finger-pull tab 42 is pulled up and (to the left) toward container closure 12 at an angle to undulated boundary line 17.

In, for example, a third case resulting in third tear pattern 100R, finger-pull tab 42 included in near end tear strip 14 is being pulled up and (to the right) toward container closure 12 at an angle to undulated boundary line 17 by a consumer to tear tear fields 16F in frangible connector 16 during removal of tear strip 14 from underlying container 20 and adjacent container closure 12 is shown in FIG. 10A. FIG. 10B is an enlarged diagrammatic view of a portion of the frangible connector taken from a circled region of FIG. 10A showing an illustrative ANGLED-RIGHT tear line 100R in tear field 16F that is created when finger-pull tab 42 is pulled up and (to the right) away from container closure 12 at an angle to undulated boundary line 17.

In the present disclosure, an illustrative cut pattern embodied by a series of alternating boundary apertures 16A and tear fields 16F are provided along a boundary line in a frangible connector 16 provided between a closure 12 and a tear strip 14 to address problems associated with resealable label closures in packages. Packaging labels are often made from a sheet of bi-axially oriented film and such a sheet can comprise a single layer or multiple layers. Bi-axially oriented film is characterized by dimensional stability (e.g., stiffness, strength, and modulus), processability, and reasonable cost.

In accordance with the present disclosure, if a consumer does not pull tear strip 14 in a STRAIGHT-UP DIRECTION in tear strip peel direction 14P as suggested in FIG. 8B, but instead pulls tear strip 14 at a slight angle to the left as suggested in FIG. 9B or in a slight angle to the right as suggested in FIG. 10B, tear strip 14 can still be removed in one piece without premature breakage and loss of availability of an unbonded handgrip portion 34 to initiate further removal of broken tamper-evident tear strip 14. In accordance with the present disclosure, tear propagation is successful when tear strip 14 is removed before closure 12 is peeled back, even if tear strip 14 is peeled at an angle to undulated boundary line 17 as suggested in FIGS. 9A and 10A.

In accordance with the present disclosure, any stress concentrator that may be created during peeling of tamper-evident tear strip 14 in tear strip peel direction 14P is located in spaced-apart relation to the edge of unbonded handgrip portion 34 of tear strip 14. The stress concentrator and any remaining portion of the tear field 16F are generally deformed and folded out of the way as the consumer grasps the unbonded handgrip portion 34, thereby minimizing unintended tears during peeling.

A package 19 includes a container 20 and a container label 10 in accordance with the present disclosure as suggested in FIGS. 1 and 4A. Container 20 is formed to include an interior product-storage region 27 and a top aperture 22 opening into the interior product-storage region 27 as suggested in FIG. 1. Container label 10 includes a closure 12 coupled to container 20 to close top aperture 22 and a tamper-evident tear strip 14 having a container-anchor portion 40 and a finger-pull tab 42 coupled to container-anchor portion 40 as suggested in FIG. 4B. Closure 12 is joined to the container-anchor portion 40 of tamper-evident tear strip 14 by a frangible connector 16 extending along an undulated boundary line 17 as suggested in FIGS. 2 and 5A.

Frangible connector 16 comprises a series of tear fields 16F that are arranged to lie in spaced-apart relation to one another along the undulated boundary line 17 as suggested in FIGS. 2 and 8A. A C-shaped boundary aperture 16A5 (for example) is formed in container label 10 and is arranged to extend along the undulated boundary line 17 and lie between a pair of adjacent tear fields 16F as shown in FIGS. 9A and 9B. Several C-shaped boundary apertures 16A0, 16A1, etc. . . . are formed in container label 10 to lie in end-to-end relation to one another and each pair of adjacent C-shaped boundary apertures 16A0, 16A1, etc. . . . is separated by one of the tear fields 16F as suggested in FIGS. 1, 2, and 8A-10A.

An edge portion 40E of container-anchor portion 40 of tamper-evident tear strip 14 that borders a first 16A1 of the C-shaped boundary apertures 16A faces toward closure 12 and has a convex shape as shown in FIG. 5A. An edge portion 12E of the closure 12 that borders the first 16A1 of the C-shaped boundary apertures 16A faces toward container-anchor portion 40 of tamper-evident tear strip 14 and has a concave shape as also shown in FIG. 5A. Edge portions 12E, 40E are arranged to lie in uniformly spaced-apart relation along the lengths thereof to one another to define the first 16A1 of the C-shaped boundary apertures 16A therebetween as suggested in FIG. 5A.

The first 16A1 of the C-shaped boundary apertures 16A comprises, in series, a curved first end segment 54, a straight middle segment 53, a curved middle segment 56, and a negatively sloping straight second end segment 55 as shown in FIGS. 5A and 5B. A second 16A2 of the C-shaped boundary apertures 16A comprises, in series, a curved first end segment 54, a straight middle segment 53, a curved middle segment 56, and a negatively sloping straight second end segment 55 as suggested in FIGS. 5A and 5B. The curved first end segment 54 of the first 16A1 of the C-shaped boundary apertures 16A is arranged to lie in spaced-apart relation to the negatively sloping straight second end segment 55 of the second 16A2 of the C-shaped boundary apertures 16A to define one of the tear fields 16F therebetween as shown in FIGS. 5A and 5B. Each of the segments 53-56 is formed in container label 10 to have a uniform width 16W extending laterally between edge portion 40E of container-anchor portion 40 and edge portion 12E of closure 12 as suggested in FIG. 5A.

Each C-shaped boundary aperture 16A has a first terminal end 51 located on the undulated boundary line 17 and an opposite second terminal end 52 located on the undulated boundary line 17 and arranged to lie between finger-pull tab 42 and first terminal end 51 as suggested in FIG. 5A. A first of the tear fields 16F is positioned to lie between the first terminal end 51 of a first 16A1 of the C-shaped boundary apertures 16A and the second terminal end 52 of an adjacent second 16A2 of the C-shaped boundary apertures 16A as suggested in FIG. 5A. First terminal end 51 of the first C-shaped boundary aperture 16A2 provides a tear initiation point for the first of the tear fields 16F during movement of finger-pull tab 42 relative to closure 12 and toward the first 16A1 of the C-shaped boundary apertures 16A to tear the tear fields 16F and separate container-anchor portion 40 of tamper-evident tear strip 14 from closure 12.

The first 16A1 of the C-shaped boundary apertures 16A comprises a straight middle segment 53 arranged to lie between the first terminal end 51 thereof and the second terminal end thereof 52, a curved first end segment 54 arranged to interconnect the straight middle segment 53 and the first terminal end 51 of the first 16A1 of the C-shaped boundary apertures 16A, and a negatively sloping straight second end segment 55 arranged to terminate at the second terminal end 52 of the first 16A1 of the C-shaped boundary apertures 16A as shown, for example, in FIG. 5A. The first 16A1 of the C-shaped boundary apertures 16A also includes a curved middle segment 56 arranged to interconnect the straight middle segment 53 and the negatively sloping straight second end segment 55.

The adjacent second 16A2 of the C-shaped boundary apertures 16A comprises a straight middle segment 53 arranged to lie between the first terminal end 51 thereof and the second terminal end 52 thereof, a curved first end segment 54 arranged to interconnect the straight middle segment 53 and the first terminal end 51 of the second 16A2 of the C-shaped boundary apertures 16A2, and a negatively sloping straight second end segment 55 arranged to terminate at the second terminal end 52 of the second 16A2 of the C-shaped boundary apertures 16A2 as shown, for example, in FIG. 5A. The second 16A2 of the C-shaped boundary apertures 16A also includes a curved middle segment 56 arranged to interconnect the straight middle segment 53 and the negatively sloping straight second end segment 55 of the second 16A2 of the C-shaped boundary apertures 16A.

Each of the straight middle segments 53 are aligned in substantially collinear relation to a straight reference line 53R as suggested in FIG. 5B. The first terminal end 51 of each of the C-shaped boundary apertures 16A is arranged to lie at a first distance (d) from the straight reference line 53R and to intersect a first-terminal-point reference line 51R that is arranged to lie in spaced-apart parallel relation to the straight reference line 53R as suggested in FIG. 5B. The second terminal end 52 of each of the C-shaped boundary apertures 16A is arranged to lie at a relatively greater second distance (D) from the straight reference line 53R and to intersect a second-terminal-point reference line 52R that is arranged to lie in a spaced-apart parallel relation to the straight reference line 53R as suggested in FIG. 5B.

The first 16A1 of the C-shaped boundary apertures 16A comprises a substantially straight middle segment 53 that is aligned in substantially collinear relation to a straight reference line 53R as suggested in FIG. 5B. The first terminal end 51 of the first 16A1 of the C-shaped boundary apertures 16A is arranged to lie at a first distance ($d_1$) from the straight reference line 53R. The second terminal end 52 of the first 16A1 of the C-shaped boundary apertures 16A is arranged to lie at a relatively greater second distance ($D_1$) from the straight reference line 53R.

The second 16A2 of the C-shaped boundary apertures 16A comprises a substantially straight middle segment 53 that is aligned in collinear relation to a straight reference line 53R as suggested in FIG. 5B. The first terminal end 51 of the second 16A2 of the C-shaped boundary aperture 16A is arranged to lie at a first distance ($d_2$) from the straight reference line 53R. The second terminal end 52 of the second 16A2 of the C-shaped boundary apertures 16A is arranged to lie at a relatively greater second distance ($D_2$) from the straight reference line 53R as suggested in FIG. 5B.

A C-shaped boundary aperture 16A is formed in the container label 10 between each pair of consecutive tear fields 16F and along the undulated boundary line 17 to provide means for fracturing each tear field 16F included in the frangible connector 16 to cause separation of tear strip 14 from closure 12 along undulated boundary line 17 without unwanted tearing of tamper-evident tear strip 14 or closure 12 during pulling movement of finger-pull tab 42 included in tamper-evident tear strip 14 in a direction generally along undulated boundary line 17 as suggested in FIG. 8A or generally toward closure 12 at an acute angle to the undulated boundary line 17 as suggested in FIG. 9A or generally away from closure 12 at an acute angle to the undulated boundary line 17 as suggested in FIG. 10A.

Closure 12 comprises a cover 30, a bonding flange 32 arranged to surround cover 30, and an unbounded handgrip portion 34 appended to bonding flange 32 at a tear-strip end 12T of closure 12 as suggested in FIG. 4A. Bonding flange 32 is arranged to mate with a ring-shaped label-bonding zone 32B provided on a top wall 24 of container 20 to support closure 12 in an aperture-closing position above the top aperture 22 as suggested in FIGS. 1 and 4A. Closure 12 further comprises means 32A for bonding the bonding flange 32 of closure 12 and container-anchor portion 40 of tamper-evident tear strip 14 to top wall 24 of container 20 without bonding the unbonded handgrip portion 34 of closure 12 to top wall of container 20 as suggested in FIG. 4B.

The unbonded handgrip portion 34 is arranged to interconnect bonding flange 32 of closure 12 and tear fields 16F of frangible connector 16 to allow the unbonded handgrip portion 34 to be exposed and gripped by a consumer that wishes to peel back the closure 12 in a closure peel direction 12P that extends away from the undulated boundary line 17 after tamper-evident tear strip 14 has been peeled away in a tear strip peel direction 14P that extends along the undulated boundary line 17. Each tear field 16F comprises a tearable material that is configured to be torn by a consumer during removal of tamper-evident tear strip 14 from top wall 24 of the container 20 and separation of tamper-evident tear strip 14 from the unbonded handgrip portion 34 of closure 12.

An edge portion 40E of the container-anchor portion 40 of the tamper-evident tear strip 14 that borders the first 16A1 of the C-shaped boundary apertures 16A faces toward the unbonded handgrip portion 34 of closure 12 and has a convex shape as suggested in FIG. 5A. An edge portion 12E of the unbonded handgrip portion 34 of closure 12 that borders the first 16A1 of the C-shaped boundary apertures 16A faces toward the container-anchor portion 40 of tamper-evident tear strip 14 and has a concave shape as suggested in FIG. 5A. The edge portions 40E, 12E are arranged to lie in uniformly spaced-apart relation along the lengths thereof to one another to define the first 16A1 of the C-shaped boundaries 16A therebetween. The first 16A1 of the C-shaped boundary apertures 16A comprises, in series, a curved first end segment 54, a straight middle segment 53, a curved middle segment 56, and a negatively sloping straight second end segment 55.

The invention claimed is:

1. A package comprising a container formed to include an interior product-storage region and a top aperture opening into the interior product-storage region, and a container label including a closure coupled to the container to close the top aperture and a tamper-evident removable tear strip having a container-anchor portion bonded to a top wall of the container and a finger-pull tab, unbonded to the top wall of the container and coupled to the container-anchor portion, wherein the closure is joined to the container-anchor portion of a tamper-evident tear strip by a frangible connector extending along an undulated boundary line, wherein the frangible connector comprises a series of tear fields that are arranged to lie in spaced-apart relation to one another along the undulated boundary line and a C-shaped boundary aperture is formed in the container label and is arranged to extend along the undulated boundary line and lie between a pair of adjacent tear fields wherein the C-shaped boundary aperture is formed in the container label between each pair of consecutive tear fields and along the undulated boundary line to provide means for fracturing each tear field included in the frangible connector to cause separation of the tear strip from the closure along the undulated boundary line without unwanted tearing of the tamper-evident tear strip or the closure during pulling movement of the finger-pull tab included in the tamper-evident tear strip in a direction generally along the undulated boundary line or generally toward the closure at an acute angle to the undulated boundary line or generally away from the closure at an acute angle to the undulated boundary line, wherein the closure comprises a cover, a bonding flange arranged to surround the cover, and an unbonded handgrip portion appended to the bonding flange at a tear-strip end of the closure, the bonding flange is arranged to mate with a ring-shaped label-bonding zone provided on a top wall of the container to support the cover in an aperture-closing position above the top aperture, and the closure further comprises means for bonding the bonding flange of the closure and the container-anchor portion of the tamper-evident tear strip to the top wall of the container without bonding the unbonded handgrip portion of the closure to the top wall of the container.

2. The package of claim 1, wherein several C-shaped boundary apertures are formed in the container label to lie in end-to-end relation to one another and each pair of adjacent C-shaped boundary apertures is separated by one of the tear fields.

3. The package of claim 2, wherein a portion of the container-anchor portion of the tamper-evident tear strip that borders a first of the C-shaped boundary apertures faces toward the closure and has a convex shape and an edge portion of the closure that borders the first of the C-shaped boundary apertures faces toward the container-anchor portion of the tamper-evident tear strip and has a concave shape.

4. The package of claim 3, wherein the edge portions are arranged to lie in uniformly spaced-apart relation along the lengths thereof to one another to define the first of the C-shaped boundary apertures therebetween.

5. The package of claim 2, wherein the first of the C-shaped boundary apertures comprises, in series, a curved first end segment, a straight middle segment, a curved middle segment, and a negatively sloping straight second end segment.

6. The package of claim 5, wherein a second of the C-shaped boundary apertures comprises, in series, a curved first end segment, a straight middle segment, a curved middle segment, and a negatively sloping straight second end segment and the curved first end segment of the first of the C-shaped boundary apertures is arranged to lie in spaced-apart relation to the negatively sloping straight second end segment of the second of the C-shaped boundary apertures to define one of the tear fields therebetween.

7. The package of claim 5, wherein each of the segments is formed in the container label to have a uniform width extending laterally between the edge portion of the container-anchor portion and the edge portion of the closure.

8. The package of claim 2, wherein each C-shaped boundary aperture has a first terminal end located on the undulated boundary line and an opposite second terminal end located on the undulated boundary line and arranged to lie between the finger-pull tab and the first terminal end, a first of the tear fields is positioned to lie between the first terminal end of a first of the C-shaped boundary apertures and the second terminal end of an adjacent second of the C-shaped boundary apertures, and the first terminal end of the first C-shaped boundary aperture provides a tear initiation point for the first of the tear fields during movement of the finger-pull tab relative to the closure and toward the first of the C-shaped boundary apertures to tear the tear fields and separate the container-anchor portion of the tamper-evident tear strip from the closure.

9. The package of claim 8, wherein the first of the C-shaped boundary apertures comprises a straight middle segment arranged to lie between the first terminal end thereof and the second terminal end thereof, a curved first end segment arranged to interconnect the straight middle segment and the first terminal end of the first of the C-shaped boundary apertures, a negatively sloping straight second end segment arranged to terminate at the second terminal end of the first of the C-shaped boundary apertures, and a curved middle segment arranged to interconnect the straight middle segment and the negatively sloping straight second end segment.

10. The package of claim 9, wherein the adjacent second of the C-shaped boundary apertures comprises a straight middle segment arranged to lie between the first terminal end thereof and the second terminal end thereof, a curved first end segment arranged to interconnect the straight middle segment and the first terminal end of the adjacent second of the C-shaped boundary apertures, a negatively sloping straight second end segment arranged to terminate at the second terminal end of the adjacent second of the C-shaped boundary apertures, and a curved middle segment arranged to interconnect the straight middle segment and the negatively sloping straight second end segment of the adjacent second of the C-shaped boundary apertures.

11. The package of claim 10, wherein each of the straight middle segments are aligned in substantially collinear relation to a straight reference line, the first terminal end of each of the C-shaped boundary apertures is arranged to lie at a first distance ($d_1$) from the straight reference line and to intersect a first-terminal-point reference line that is arranged to lie in spaced-apart parallel relation to the straight reference line, and the second terminal end of each of the C-shaped boundary apertures is arranged to lie at a second distance (D) from the straight reference line and to intersect a second-terminal-point reference line that is arranged to lie in a spaced-apart parallel relation to the straight reference line, wherein the second distance ($D_1$) is greater than the first distance ($d_1$).

12. The package of claim 1, wherein the unbonded handgrip portion is arranged to interconnect the bonding flange of the closure and tear fields of the frangible connector to allow the unbonded handgrip portion to be exposed and gripped by a consumer that wishes to peel back the closure in a peal direction that extends away from the undulated boundary line after the tamper-evident tear strip has been peeled away in a tear strip peel direction that extends along the undulated boundary line.

13. The package of claim 12, wherein each tear field comprises a tearable material that is configured to be torn by a consumer during removal of the tamper-evident tear strip from the top wall of the container and separation of the tamper-evident tear strip from the unbonded handgrip portion of the closure.

14. The package of claim 12, wherein a portion of the container-anchor portion of the tamper-evident tear strip that borders the first of the C-shaped boundary apertures faces toward the unbonded handgrip portion of the closure and has a convex shape and an edge portion of the unbonded handgrip portion of the closure that borders the first of the C-shaped boundary apertures faces toward the container-anchor portion of the tamper-evident tear strip and has a concave shape.

15. The package of claim 14, wherein the edge portions are arranged to lie in uniformly spaced-apart relation along the lengths thereof to one another to define the first of the C-shaped boundaries therebetween.

16. The package of claim 14, wherein the first of the C-shaped boundary apertures comprises, in series, a curved first end segment, a straight middle segment, a curved middle segment, and a negatively sloping straight second end segment.

17. The package of claim 1, wherein the frangible connector comprises a series of tear fields that are arranged to lie in spaced-apart relation to one another along the undulated boundary line and a boundary aperture is formed in the container label and is arranged to extend along the undulated boundary line and lie between a pair of adjacent tear fields, the boundary aperture has a first terminal end located on the undulated boundary line and an opposite second terminal end located on the undulated boundary line, a straight middle segment arranged to lie between and in spaced-apart relation to each of the first and second terminal ends and in collinear relation to a straight reference line, the first terminal end of the boundary aperture is arranged to lie at a first distance ($d_1$) from the straight reference line, and the second terminal end of the boundary aperture is arranged to lie at a second distance ($D_1$) from the straight reference line, wherein the second distance ($D_1$) is greater than the first distance ($d_1$).

18. A package comprising a container formed to include an interior product-storage region and a top aperture opening into the interior product-storage region, and a container label including a closure coupled to the container to close the top aperture and a tamper-evident tear strip having a container-anchor portion and a finger-pull tab coupled to the container-anchor portion, wherein the closure is joined to the container-anchor portion of a tamper-evident tear strip by a frangible connector extending along an undulated boundary line wherein the frangible connector comprises a series of tear fields that are arranged to lie in spaced-apart relation to one another along the undulated boundary line and a C-shaped boundary aperture is formed in the container label and is arranged to extend along the undulated boundary line and lie between a pair of adjacent tear fields wherein several C-shaped boundary apertures are formed in the container label to lie in end-to-end relation to one another and each pair of adjacent C-shaped boundary apertures is separated by one of the tear fields wherein each C-shaped boundary aperture has a first terminal end located on the undulated boundary line and an opposite second terminal end located on the undulated boundary line and arranged to lie between the finger-pull tab and the first terminal end, a first of the tear fields is positioned to lie between the first terminal end of a first of the C-shaped boundary apertures and the second terminal end of an adjacent second of the C-shaped boundary apertures, and the first terminal end of the first C-shaped boundary aperture provides a tear initiation point for the first of the tear fields during movement of the finger-pull tab relative to the closure and toward the first of the C-shaped boundary apertures to tear the tear fields and separate the container-anchor portion of the tamper-evident tear strip from the closure, wherein the first of the C-shaped boundary apertures comprises a substantially straight middle segment that is aligned in substantially collinear relation to a straight reference line, the first terminal end of the first of the C-shaped boundary apertures is arranged to lie at a first distance ($d_1$) from the straight reference line, and the second terminal end of the first of the C-shaped boundary apertures is arranged to lie at a second distance ($D_1$) from the straight reference line, wherein the second distance ($D_1$) is greater than the first distance ($d_1$).

19. The package of claim 18, wherein the second of the C-shaped boundary apertures comprises a substantially straight middle segment that is aligned in collinear relation to a straight reference line, the first terminal end of the second of the C-shaped boundary apertures is arranged to lie at a first distance ($d_2$) from the straight reference line, and the second terminal end of the second of the C-shaped boundary apertures is arranged to lie at a relatively greater second distance ($D_2$) from the straight reference line, wherein the second distance ($D_2$) is greater than the first distance ($d_2$).

* * * * *